United States Patent [19]

Silbernagel

[11] Patent Number: 4,723,393

[45] Date of Patent: Feb. 9, 1988

[54] TWIN ROLL LAMINATED PACKAGING PROCESS

[75] Inventor: Peter Silbernagel, Ochtrup, Fed. Rep. of Germany

[73] Assignee: B. Hagemann GmbH & Co., Steinfurt, Fed. Rep. of Germany

[21] Appl. No.: 887,984

[22] Filed: Jul. 25, 1986

Related U.S. Application Data

[63] Continuation of Ser. No. 665,063, Oct. 26, 1984, abandoned.

[30] Foreign Application Priority Data

Oct. 29, 1984 [DE] Fed. Rep. of Germany ..... 3339337

[51] Int. Cl.[4] ..... B65B 13/12

[52] U.S. Cl. ..... 53/556; 53/210; 53/557

[58] Field of Search ..... 53/170, 176, 210, 399, 53/441, 449, 465, 557, 588, 556; 100/13, 27; 493/297, 298, 299, 300

[56] References Cited

U.S. PATENT DOCUMENTS

| | | | |
|---|---|---|---|
| 934,683 | 9/1909 | Lutz | 493/298 |
| 1,671,376 | 5/1928 | Parker | 100/27 |
| 2,026,469 | 12/1935 | Hamilton | 53/588 X |
| 3,216,307 | 11/1965 | Griffith | 53/449 X |
| 4,050,220 | 9/1977 | Lancaster et al. | 53/588 X |

FOREIGN PATENT DOCUMENTS

| | | | |
|---|---|---|---|
| 2303590 | 8/1973 | Fed. Rep. of Germany | 53/210 |
| 2319485 | 10/1973 | Fed. Rep. of Germany | 53/557 |

*Primary Examiner*—Paul A. Bell
*Assistant Examiner*—Michael D. Folkerts
*Attorney, Agent, or Firm*—Cushman, Darby & Cushman

[57] ABSTRACT

Process and apparatus for an orbital stretch wrapper to form two superimposed layers of opposite pitch on items or bundles. Shrinkable film is drawn off two separate supply rolls under tension simultaneously in opposing rotational directions. The rolls are placed successively along the length of a conveyor belt separated by at least one width of the film.

8 Claims, 1 Drawing Figure

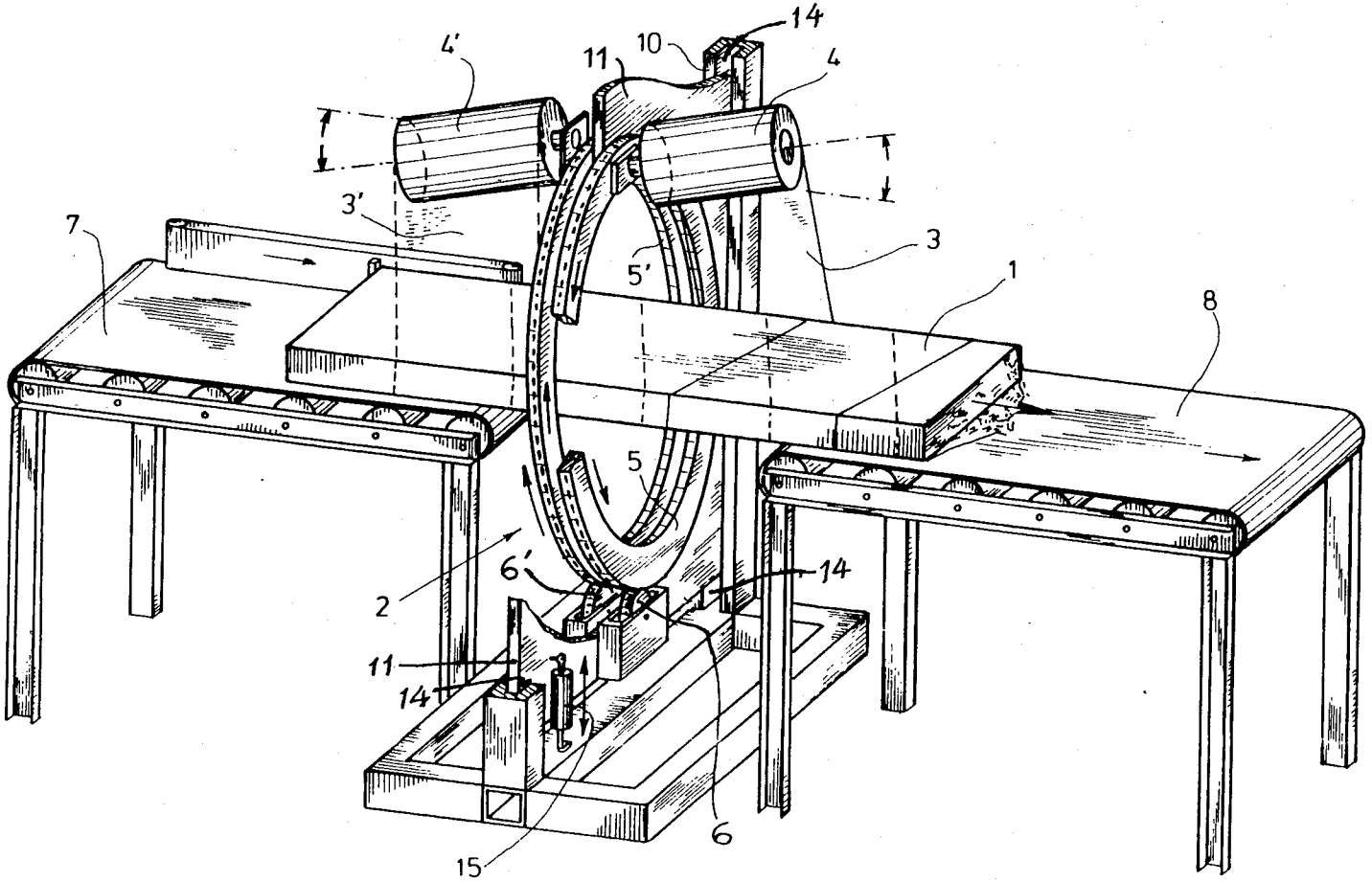
8
1
3
4
14
10
11
5'
5
4'
3'
7
6
14
6'
2
11
14
15

TWIN ROLL LAMINATED PACKAGING PROCESS

This is a continuation of application Ser. No. 665,063, filed Oct. 26, 1984, which was abandoned upon the filing hereof.

This invention relates to a process and an apparatus for packaging objects with wrapping material. Specifically, it is concerned with an orbital stretch wrapper for drawing off shrinkable film from two supply rolls and wrapping the drawn off material onto objects to be wrapped which are conveyed through a wrapping zone.

BACKGROUND OF THE INVENTION

Recent years have seen the development of stretchable and shrinkable films for use in packaging. The inherent film tension of these shrinkable films permits them to be wrapped around objects so as to compress (and "package") the objects without the film breaking. Known examples of such films include the trademark films PRESTO-STRETCH-GARD, PRESTO-BUNDLE-GARD, and PRESTO-STRETCH-GARD IV.

Various packaging techniques are known which use shrinkable films. One existing process and apparatus is the "Toroid" orbital stretch wrapper of the OVER-WRAP Equipment Corporation of Fairfield, N.J. This orbital stretch wrapper utilizes a single roll of shrinkable film which is rotatably transported around an object to be wrapped. A conveyor belt mechanism moves the object to be wrapped through a wrapping zone defined by the rotational movement of the roll. The rotational axis formed by the drawing off of material from the single supply roll is situated parallel to the direction of movement of the objects.

Various problems associated with known packaging technology using shrinkable film include uneven or non-smooth wrapping of the film around the desired object, and uneven tension in the wrapping material as the object is packaged. The uneven tension (and associated uneven pressures) brought to bear on the objects may cause stackable objects to become displaced with respect to one another. Single objects which may not withstand the pressure necessary to tightly stretch the shrinkable film around the object can become deformed during packaging.

The U.S. patent to Lancaster, et al. (U.S. Pat. No. 4,317,322) teaches a rotatable circular device encompassing a conveyed object so as to cause wrapping materials to be spirally wound onto an object. This operation reduces the likelihood of non-smooth wrapping, but does not eliminate it due to the parallel placement of the roll of wrapping material with respect to the direction of the movement of the object. (Refer specifically to FIGS. 3 and 7 and Column 12 of the patent.)

SUMMARY OF THE INVENTION

The present invention provides an arrangement including a process and apparatus addressing at least these problems of prior orbital stretch wrapper ane having other advantages. The invention is concerned with minimizing distortions in the wrapping material as it is applied to the object desired to be wrapped.

This invention further addresses the undesirable occurrence of unequal tension in applying wrapping materials, and it addresses the safe wrapping of crushable items and items which tend to be displaced by application of a wrapping material with known packaging techniques.

The present invention provides an orbital stretch wrapper having two wrap supply rolls which are transported around a conveyed object so as to wind wrapping material from the rolls and onto the objects. Two superimposed layers of wrapping material of opposite pitch are formed around the object with an even distribution of pressure.

A further feature of the present invention includes the respective opposite rotation of the wrap rolls around the objects so as to prevent single-direction pressure on the objects which would tend to displace them from their position with respect to each other, or with respect to a conveyor belt mechanism.

Two parallel rings are adapted to carry in opposite directions the wrap supply rolls mounted thereon. These mounted rolls are adapted to have an axial alignment which is angularly displaced from a line parallel to the direction of movement of the conveyor belt. Such non-parallel alignment permits a smoother flow of the wrapping material onto or around the objects.

Because of the even distribution of pressure to the objects generated by the oppositely rotated wrap supply rolls, likelihood of injury to the packaged goods (or their displacement) is minimized. No single-direction pressure acts on the objects as in the prior packaging techniques. Therefore, undesirable displacement does not occur.

BRIEF DESCRIPTION OF THE DRAWING

These as well as other features and advantages of this invention may be better understood by reading the following detailed description of the presently preferred exemplary embodiment and the accompanying drawing, in which:

FIG. 1 is a perspective view of the apparatus of the present invention.

DETAILED DESCRIPTION OF THE PREFERRED EMBODIMENT

The present invention provides an orbital stretch wrapper for packaging objects comprising first and second wrap rolls, each having wrapping material prerolled thereon; spiral wrap means, having a center passageway, for transporting the first and second wrap rolls so as to unwind the wrapping material from the first and second wrap rolls and further so as to wind the wrapping material around the objects to be packed; and conveyor belt means for conveying the objects to be packed through the above-described passageway, wherein the wrapping material forms with an even distribution of pressure such that two superimposed layers of wrapping material deposited around the objects to be packed.

The present invention also provides an orbital stretch wrapper wherein the above-described spiral wrap means includes ring means for transporting the wrapping rolls respectively in opposite rotational directions around the objects to be packed. The ring means can be described as comprising two parallel rings adopted to each respectively transport first or second wrap rolls, with each of the wrap rolls adoptively mounted on a respective ring so as to have an axial alignment which is angularly displaced from a line parallel to the direction of movement of the conveyor belt means.

The present invention also contemplates an embodiment wherein an orbital stretch wrapper further includes a piston means for selectively positioning the spiral wrap means within a plane which is perpendicular to the direction of movement of the conveyor belt means.

The present invention also contemplates the orbital stretch wrapper as above-described including the ring means wherein the ring means are adopted with peripheral notches to be driven in respectively opposite rotational directions by two driving pinions and a single motive device.

The present invention also contemplates an embodiment including the ring means wherein the first and second wrap rolls are displaced a distance from each other along a direction of movement of the conveyor belt means which is defined by at least the width of the wrapping material and further wherein the angular displacement of wrap rolls is within a range of 2° to 20°. A further refinement of this embodiment includes an orbital stretch wrapper having a supporting wall adopted to receive and support the ring means and a holding frame having grooves therein adopted to receive and hold the supporting wall.

Again, in the embodiment of an orbital stretch wrapper contemplating ring means, the area of operation of the ring means with rolls mounted thereon constitutes a wrapping zone and the conveyor belt means is discontinuous within the thus defined wrapping zone so as to permit unimpeded winding of the wrapper material around the objects to be wrapped.

A still further refinement includes an orbital stretch wrapper including ring means wherein the ring means includes means for winding each of the wrapped rolls of material onto the objects to be wrapped with respectively selected tension.

The present invention also contemplates a method of packaging objects comprising the steps of: providing first and second rolls of wrapping material; conveying the objects to be wrapped through a wrapping zone; displacing the rolls within the wrapping zone and a distance from each other of at least the width of the wrapper material, and displacing the rolls such that the rotational axes are not parallel with the direction of conveyance of the objects to be wrapped through the wrapping zone; and simultaneously rotatably transporting the rolls in respective opposite directions around the objects to be wrapped while the objects are conveyed through the wrapping zone so as to unwind the wrapper material from the rolls and onto the objects whereby the wrapping material forms two superimposed layers of opposite pitch around the objects.

This method also contemplates additional embodiments. One embodiment includes a provision wherein the conveying step utilizes a conveyor device which is discontinuous in the wrapping zone so that wrapping of the objects is unimpeded and is accomplished with displacement force imparted to the object from the wrapping material of one supply roll being offset by the displacement force of the wrapping material provided from the other supply roll. An additional embodiment may further include the refinement wherein the wrapping tension and the width of the wrapping material is respectively selectable for each roll, and the displacement of the rolls from parallel is also selectable. In a still further embodiment, the wrapping material may comprise shrinkable film.

FIG. 1 is a perspective representation of an exemplary apparatus for wrapping objects 1 in accordance with the present invention. These objects may be individually packed items or they may be bundles. In the packaging art, a packed item usually denotes a single or an enclosed item, which however may be compressible (such as a roll of carpet). A bundle usually refers to multiple items which are stacked together (e.g., such as cartons). Such bundled items are frequently displaced with respect to one another by known packaging techniques due to the uneven pressure which these techniques apply to bundles during a packaging operation. The twin-roll wrapping mechanism of the present invention is equally applicable to both packed items and bundles, but it is particularly useful in wrapping bundles without causing any undesirable displacement of them as occurs in the known techniques.

A winding film guiding device 2 supports two wrap supply rolls 4 and 4'. These wrap supply rolls are respectively associated with pre-rolled wrapping material 3 and 3'. This wrapping material may comprise a band of wrapping film, such as the shrinkable film discussed above, or any equivalent wrapping material which is suitable for pre-rolling.

FIG. 1 shows the direction of wrapping for the band of wrapping films 3 and 3' as the object to be wrapped 1 is conveyed through a wrapping zone. The wrapping directions for the two films are respectively opposite to each other in this Figure, although the invention also envisions "same-direction" wrapping (particularly where the potential for displacement may be slight—e.g., single, large, relatively non-compressible items).

The supply rolls 4 and 4' are each mounted individually on axies which are respectively associated with rings 5 and 5'. These rings each have notches on their outer periphery which engage with driving pinions 6 and 6', respectively. These driving pinions may be driven by the same motor (not shown) so that the rings are driven in opposite directions as indicated by the arrows. Other equivalent driving mechanisms are permitted by and within the scope of the present invention, so long as the supply rolls are rotatable around the object to be packaged.

Conveyor belts 7 and 8 transport the objects 1 through a wrapping zone by passing them through an inner opening of the rings 5 and 5'. The conveyor belt mechanism is discontinuous in the area of the wrapping zone to permit unimpeded wrapping of the object 1. Alternatively, a bridge conveyor may be used to convey packed items or bundles through the rings 5 and 5', where more support is needed through the wrapping zone.

The winding station is surrounded by a holding frame 10, which is formed with grooves 14 for engaging a supporting wall 11. The supporting wall 11 is adapted to support the rotating rings 5 and 5'.

The height of the ring mounts 5 and 5' is adjustable by operation of a piston cylinder device 15. This device is associated with the supporting wall 11 to thereby selectively move (up and down) the rings 5 and 5' in a plane which is perpendicular to the direction of movement of the objects 1.

In operation, conveyor belts 7 and 8 cause objects 1 to be conveyed through the inner opening of rings 5 and 5'. Simultaneously, driving pinions 6 and 6' rotate rings 5 and 5' in opposite directions as shown by the arrows of FIG. 1.

During rotation of the rings, the supply rolls (with pre-rolled wrapping film 3 and 3' respectively stored thereon) draw off the shrinkable wrapping film under tension in a manner so as to wrap the object 1 as shown.

As the object 1 passes through the wrapping zone, two superimposed winding film layers of opposite pitch (angle of contact between the object and the respective film) are formed around the object to "package" them.

The two supply rolls are separated a distance from one another along the length of the conveyor belts 7 and 8 defined by at least the width of the wrapping film. This permits unimpeded formation of two superimposed layers on the object as a result of operation of this orbital stretch wrapper in accordance with the present invention.

A smooth flow of wrapping film onto and around the object 1 is assured by the angular deviation (shown in FIG. 1) of the supply rolls from a line parallel to the conveyor belt direction of movement.

Displacement of objects 1 from the conveyor belts 7 and 8 is minimized by the simultaneous oppositely-directed rotational wrapping feature of the present invention. As supply rolls 4 and 4' are rotated in opposite directions around object 1, the pressures (i.e., displacement forces) applied to the object by the film 3 and 3', respectively, offset each other due to their opposite nature. Therefore, no undesirable displacement occurs, and the minimum application of pressure necesary to wrap the object 1 may be reduced to further ensure the safety of potentially deformable objects.

Different wrapping films may have different inherent tension (and other) charactistics. The present invention accomodates any such differing characteristics by providing a variable angle of deviation for the supply rolls with respect to the parallel movement of the conveyor belt. Accordingly, it is a feature of the present method and apparatus to permit selective establishment of a deviation angle within the range of two to twenty degrees from "parallel". Further adaptive features of the present method and apparatus (to suitably package a great variety of particular objects with various wrapping films) include varying the width between the two supply rolls so long as the width is maintained at least as wide as the selected wrapping material. The actual width of the wrapping material itself may also be varied, as well as varying the selection of tension under which wrapping is operated.

Many modifications and variations will be appreciated by those skilled in the art without departing from the advantages and novel features of the present invention. For example, a relatively less wide film may be used for supply roll 4' with a wider film to follow on top of it from supply roll 4. Alternatively, the "downstream" supply roll 4 may be operated with a higher tension for its wrapping material 3 than the wrapping material 3' tension associated with initial supply roll 4'. Thus, relatively high stress tensions can be transferred in accordance with the present invention so that special kinds of stretchable film ordinarily difficult to operate with may be employed.

A further variation or modification to the presently preferred embodiment may be to separate rings 5 and 5' so that they are in fact driven by separate driving mechanisms, thereby enabling selective and respective rotational operation as desired. A twin drive system would have a higher manufacturing cost than the single drive mechanism of FIG. 1. However, it would permit selective rotation of a single supply roll as desired without the necessity of removing wrapping material from one of the rollers. Alternatively, one of the driving pinions could be adapted so as to be selectively engagable to equivalently achieve selective drive of the two supply rolls with a single drive means. The considerable adjustment flexibility of the present invention permits sufficient adaptation to perform packaging operations on even especially bulky items. Accordingly, utilization of the features of the present invention permit superior packaging of both packed items and bundles.

Although only one presently preferred embodiment has be described in detail, those skill in the art will appreciate that many variations and modifications other than those stated above may be made to this embodiment without departing from the advantages and novel features of the present invention. Therefore, all such additional modifications and variations are intended to be included within the scope of the appended claims.

I claim:

1. An orbital stretch wrapper for packaging objects comprising:

first and second wrap rolls, each wrap roll having wrapping material pre-rolled thereon;

spiral wrap means, having a center passageway, for transporting said wrap rolls so as to unwind said wrapping material from said rolls and so as to wind said material around said objects;

conveyor belt means for conveying said objects through said passageway;

said spiral wrap means including a support wall and ring means for transporting said wrap rolls respectively in opposite rotational directions around said objects, said ring means comprising first and second parallel full circle rings received and supported respectively on a face and a backside of said support wall, said rings being adapted to each respectively support one of said wrap rolls, each said wrap roll being adapted to be mounted on its respective ring so as to have a longitudinal axis which is angularly displaced from a line parallel to the direction of movement of a conveyor belt means; and adjusting means for selectively positioning said supporting wall with said rings within a plane which is perpendicular to said conveyor belt means;

wherein said wrapping material forms, with an even distribution of pressure, two superimposed layers around said objects.

2. A wrapper as in claim 1 wherein said ring means are adapted with peripheral notches to be driven in respectively opposite rotational directions by two driving pinions and a single motive device.

3. A wrapper as in claim 1, wherein said rolls are spaced apart a predetermined distance along said direction of movement of the conveyor belt means; and said angular displacement of said rolls is within range of 2° to 20°.

4. A wrapper as in claim 3, further comprising:

a holding frame having grooves adapted to receive and hold said supporting wall.

5. A wrapper as in claim 1, wherein the area of operation of said ring means with rolls mounted thereon constitutes a wrapping zone; and said conveyor belt means is discontinuous in said wrapping zone so as to permit unimpeded winding of said wrapping material around said objects.

6. A wrapper as in claim 1 wherein said wrapping material comprises shrinkable film.

7. A wrapper as in claim 1, wherein said wrapping material is of selected width for each roll; and said ring means comprises means for winding each of said rolls of material onto to said objects with respectively selected tension.

8. The wrapper of claim 1 wherein said adjusting means is a piston cylinder.

* * * * *